US006322289B1

(12) United States Patent
Nolan

(10) Patent No.: US 6,322,289 B1
(45) Date of Patent: Nov. 27, 2001

(54) STEP SILT TERRACE EROSION PREVENTION

(76) Inventor: John Thomas Nolan, 22 E. Court St., Iowa City, IA (US) 52240

( * ) Notice: Subject to any disclaimer, the term of this patent is extended or adjusted under 35 U.S.C. 154(b) by 0 days.

(21) Appl. No.: 09/236,739

(22) Filed: Jan. 25, 1999

(51) Int. Cl.[7] ..... E02B 7/02
(52) U.S. Cl. ..... 405/116; 405/107; 405/15
(58) Field of Search ..... 405/15, 16, 17, 405/18, 19, 21, 25, 32, 107, 108, 114, 115, 116, 258

(56) References Cited

U.S. PATENT DOCUMENTS 1,026,616 * 5/1912 Stratton ..... 405/16
3,957,098 * 5/1976 Hepworth et al. ..... 405/17
4,405,257 * 9/1983 Nielsen ..... 405/18
4,449,847 * 5/1984 Scales et al. ..... 405/18
4,486,121 * 12/1984 Thompson et al. ..... 405/18
4,521,131 * 6/1985 Nandlal ..... 405/15
4,650,368 * 3/1987 Bayer ..... 405/18
4,693,632 * 9/1987 Ingersoll ..... 405/18
5,584,599 * 12/1996 Knittel ..... 405/15
5,595,458 * 1/1997 Grabhorn ..... 405/16

FOREIGN PATENT DOCUMENTS

133204 * 6/1987 (JP) ..... 405/25

* cited by examiner

*Primary Examiner*—David Bagnell
*Assistant Examiner*—Frederick L. Lagman

(57) ABSTRACT

The Silt terrace erosion prevention inventions called STEP, is directed to a low cost process to reverse soil erosion in a farm field by retaining the silt in a natural watercourse to form grassy terraces behind a series of dam structures built with dirt-filled, non-biodegradable, plastic sacks arranged across the bed of the gully in a "V" shape pointing upstream.

1 Claim, 3 Drawing Sheets

STEP SILT TERRACE EROSION PREVENTION

BACKGROUND OF THE INVENTION

FIELD OF THE INVENTION

The Silt terrace erosion prevention invention, called STEP, is a low cost process to stop gully erosion by the creation of a series of silt filled terraces over a period of time to provide at maturity, a permanent land bridge of grass strip vegetation across what previously was an uncrossable ditch barricade to contour farming.

Erosion control on tillable fields has been a long standing concern of farmers. In areas where storms and intermittent water run off have created gully erosion, various methods have been employed to counteract the loss of valuable soil and disruption of agricultural pursuits, especially for contour farming. The known methods of erosion control in prior art are expensive and cause major topsoil loss and disruption and/or are temporary. Few have provided long range satisfaction to the farm operator.

Technology now provides rugged, durable, woven plastic sacks, which can be filled with dirt dug at the site of STEP. These, when placed in the specific V-shaped arrangement in the streambed form structural STEP dam terraces. The process for which this patent is claimed causes sediment to be impounded and concentrates water flows in the center of the stream thus protecting the gully terrace from washout and side banks from further erosion.

BRIEF SUMMARY OF THE INVENTION

This invention comprises a series of structures formed with a number of earth filled plastic sacks in a V-shaped formation, pointing upstream, from bank to bank across the gully bed. The specific formation slows an oncoming stream of water causing it to pool and trap sediment while the water flow is channeled to the center of the structure and directed away from undercutting the side banks of the gully. In the event of heavy flow of stream water, the stream is expected to cascade over the top center of the structure without washing it out and to be channeled to the structure further downstream for a similar slowing effect, trapping silt in each case. A series of structures may be constructed in various places along the length of the gully. It is an object that this invention over a period of time, the silt thus retained, when seeded with a water tolerant grass cover, will provide terraces and eventually a permanent grass strip at farm field level which can be utilized for farm machinery crossings.

Figure 1:
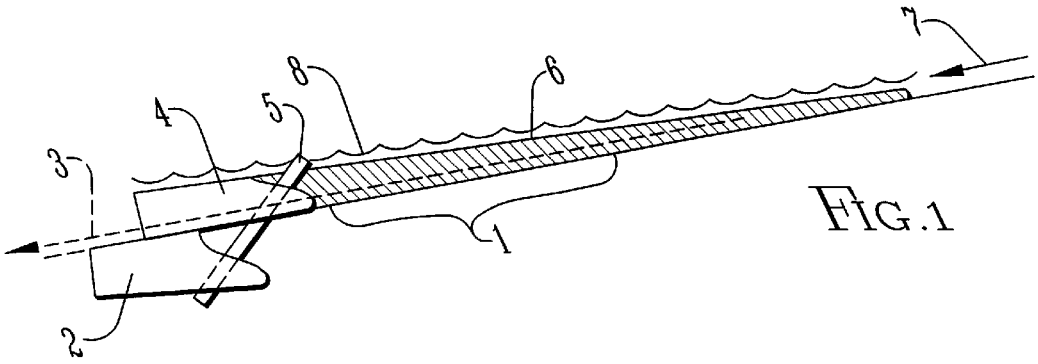
FIG. 1 shows a cross section of the STEP structure at its center following a period of silt build up.
Figure 2:
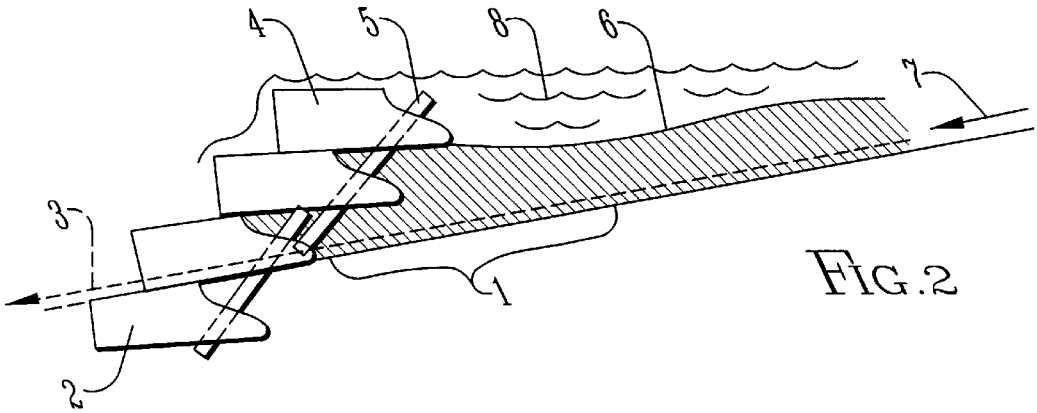
FIG. 2 is a cross section at the same plane as FIG. 1, showing the build up of the silt terrace after several years as the structure is heightened by adding layers of dirt-filled bags resting on the layer below and the impounded silt.
Figure 3:
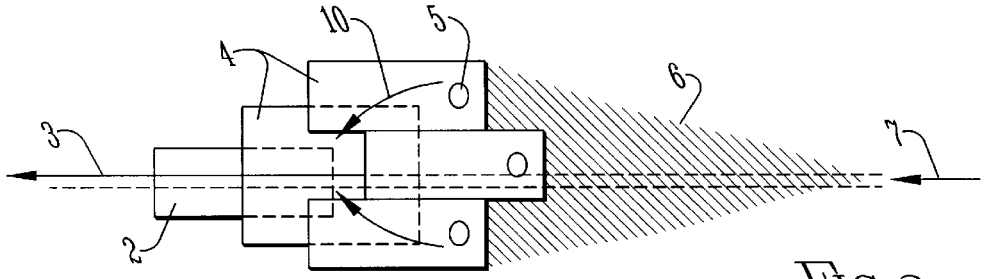
FIG. 3 is an overhead view of the cornerstone, drain tile and dirt-filled sacks at the center of the structure showing the direction of stream flow.
Figure 4:
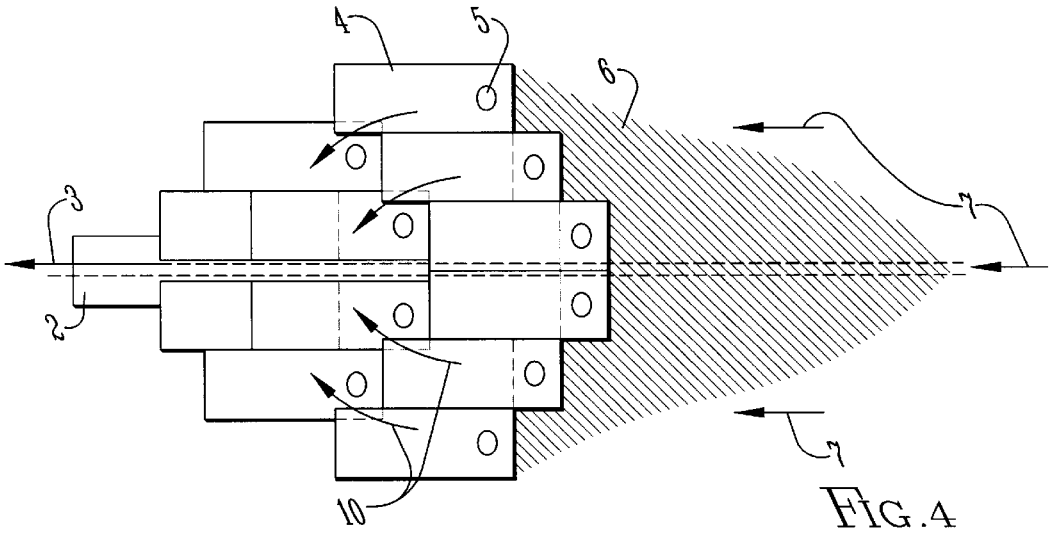
FIG. 4 shows a fragmented overhead view showing the placement of dirt-filled sacks staked into the stream bed and silt formation in the specific V-formation.
Figure 5:
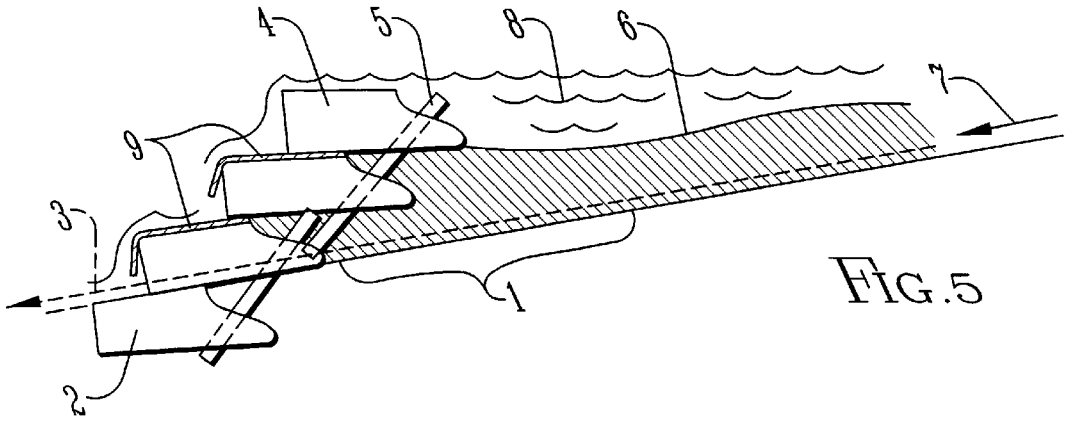
FIG. 5 shows the placement of protective sacks as deflecting aprons.

In each drawing, (1) indicates the original fall line of the gully, (2) is the cornerstone, (3) is the center drain tile, (4) represents dirt-filled sacks, (5) indicates anchor stakes, (6) is the silt terrace formation, (7) shows the direction of stream flow, (8) indicates the water pool, (9) shows placement of deflecting protective aprons, (10) shows direction of water cascade into center of the water structure and away from gully bank.

BEST MODE FOR CARRYING OUT THE INVENTION

To begin the process, dirt is used to fill non-biodegradable, rugged, woven plastic sacks (4) of the kind currently used to bag seed. The dirt is dug from the gully above the STEP structure. Each sack used should be filled approximately ⅔ full. The open end does not have to be bound. It will be secured and buried in the later siltation development of the silt terrace.

A foundation sack for each STEP terrace, the "cornerstone" (2) of the [STEP] structure is buried below the bottom of the stream bed to prevent undermining erosion and collapse of the impoundment dam. Above this cornerstone sack (2) and below the center of the structure forming a silt terrace, a 4–6 inch diameter field drainage tile (3) is laid in the thread of the stream. Each STEP terrace is drained separately by the tile which lies below its length and extends three feet downstream from the STEP structure.

The first level of silt terrace is built up behind a course of dirt-filled sacks (4) arranged on a horizontal level, from bank to bank on each side over the cornerstone and drain tile in a V-shaped arrangement, with the "V" pointing upstream. The number of sacks used depends on the width of the gully. The sacks are placed side by side with the open end lying upstream to be buried by impounded silt. When wet, the dirt-filled sacks conform perfectly to the top of the underlying surface to form a watertight barrier. Anchor stakes (5) are driven at an angle through the open ends of the sacks and into the gully stream, or silt bed.

The unique "V" shape of the STEP pointing upstream is crucial to silt buildup. It causes the flow of the watershed to be carried towards the center and sometimes over the STEP. This pulls the erosive action of the current away from the side of the stream bank. If the "V" was pointed downstream, the vortex of the "V" would tend to splay the cascading water to the side of the banks to wash out the structure.

Siltation occurs as sediment settles in the pool behind such barrier. Eventual evacuation of pooled water is achieved by drainage through the drainage tube which lies below the silt terrace.

As the water born sediment raises the silt terrace level to the top of the dirt-filled sack dam, the STEP terrace is raised by adding another course of dirt-filled sacks. Each dirt-filled sack is placed ½ on top of the sack below and ½ on the built up layer of sediment. When a new dirt-filled sack is added to the STEP, the closed end of an empty plastic sack is placed beneath the new dirt filled sack with ⅔ extending over the dirt-filled sack below as a deflecting apron (9) to protect the lower level from cascading water abrasion and flotsam spilling over the STEP. The process is continued until the silt terrace level reaches the adjacent farm field level.

A vegetation cover on each terrace level is also an integral factor in the stabilization of the STEP. As each terrace develops, it is seeded with water tolerant grass and vegetation to slow the streams flow for the STEP below.

Additional STEP terraces can be constructed to direct water run off through siltation pools and drainage tube evacuation to restore a permanent grass strip waterway until a series of land bridges is formed level with the adjacent farm fields along the entire length of the former gully.

What is claimed is:

1. A "V" shaped dam structure pointing upstream comprised of:

a. a number of dirt-filled, non-bio-degradable, rugged woven, plastic sacks;

b. an arrangement of dirt-filled sacks over a foundation sack or "cornerstone" buried in the streambed with a drainage tile resting on the cornerstone;

c. a number of dirt-filled sacks placed on both sides of the cornerstone from bank to bank to form a "V" pointing upstream to channel stream flow and collect sediment;

d. a number of dirt filled sacks placed side by side on a horizontal plain in a "V" shaped arrangement with the open end of each sack at the upstream of terrace side and secured with a stake driven through it at an angle into the surface below;

e. a number of dirt-filled sacks added layer by layer to the "V" shaped structure as silt is impounded by the barrier;

f. a water pool barrier constructed in a gully stream, to trap sediment carried by the watercourse for the formation of a silt terrace, with layers of dirt-filled sacks added over a period of time as the silt level rises until at maturity a terrace is built up which is level with the top of the gully bank and adjacent farm fields.

* * * * *